US011399674B2

(12) United States Patent
Ko

(10) Patent No.: US 11,399,674 B2
(45) Date of Patent: Aug. 2, 2022

(54) AUXILIARY COVER FOR TOILET SEAT

(71) Applicant: Changil Ko, Namyangju-si (KR)

(72) Inventor: Changil Ko, Namyangju-si (KR)

( * ) Notice: Subject to any disclaimer, the term of this patent is extended or adjusted under 35 U.S.C. 154(b) by 0 days.

(21) Appl. No.: 17/341,521

(22) Filed: Jun. 8, 2021

(65) Prior Publication Data

US 2022/0167804 A1 Jun. 2, 2022

(30) Foreign Application Priority Data

Nov. 27, 2020 (KR) ..... 10-2020-0162792

(51) Int. Cl.
*A47K 13/14* (2006.01)

(52) U.S. Cl.
CPC ..... *A47K 13/14* (2013.01)

(58) Field of Classification Search
CPC ..... A47K 13/24; A47K 13/06; A47K 13/005; A47K 13/14
USPC ..... 4/245.1
See application file for complete search history.

(56) References Cited

U.S. PATENT DOCUMENTS

| | | | | | |
|---|---|---|---|---|---|
| 948,798 | A * | 2/1910 | Steffee | A47K 13/06 | 4/239 |
| 1,682,799 | A * | 9/1928 | Richards | A47K 13/24 | 4/237 |
| 2,016,412 | A * | 10/1935 | Winding | A47K 13/24 | 4/245.3 |
| 2014/0223655 | A1* | 8/2014 | Dillard | A47K 13/24 | 4/300.3 |
| 2016/0058252 | A1* | 3/2016 | Mapes | A47K 13/06 | 4/239 |
| 2017/0164796 | A1* | 6/2017 | Fang | A47K 13/06 | |
| 2018/0084959 | A1* | 3/2018 | Hall | A47K 13/302 | |
| 2020/0008634 | A1* | 1/2020 | Hill | A47K 13/18 | |

* cited by examiner

*Primary Examiner* — Benjamin R Shaw
(74) *Attorney, Agent, or Firm* — Lex IP Meester, PLLC

(57) ABSTRACT

The present invention relates to an auxiliary seat cover for a toilet, including: a seat part having the shape of an arch corresponding to the top periphery of a bowl of the toilet; inner and outer skirt parts extended downward from inner and outer peripheries of the seat part in such a manner as to surround the inner and outer peripheries of top of the bowl of the toilet; and a slant cover extended upward from the inner periphery of top of the seat part to the outside, whereby the bowl of the toilet are prevented from being dirty by the urine or water, the urine or water naturally flows back to the interior of the bowl, and the bowl is separated from the bowl and washed in an easy manner, thereby enabling the toilet to be used in a sanitary state.

11 Claims, 13 Drawing Sheets

【FIG. 1】
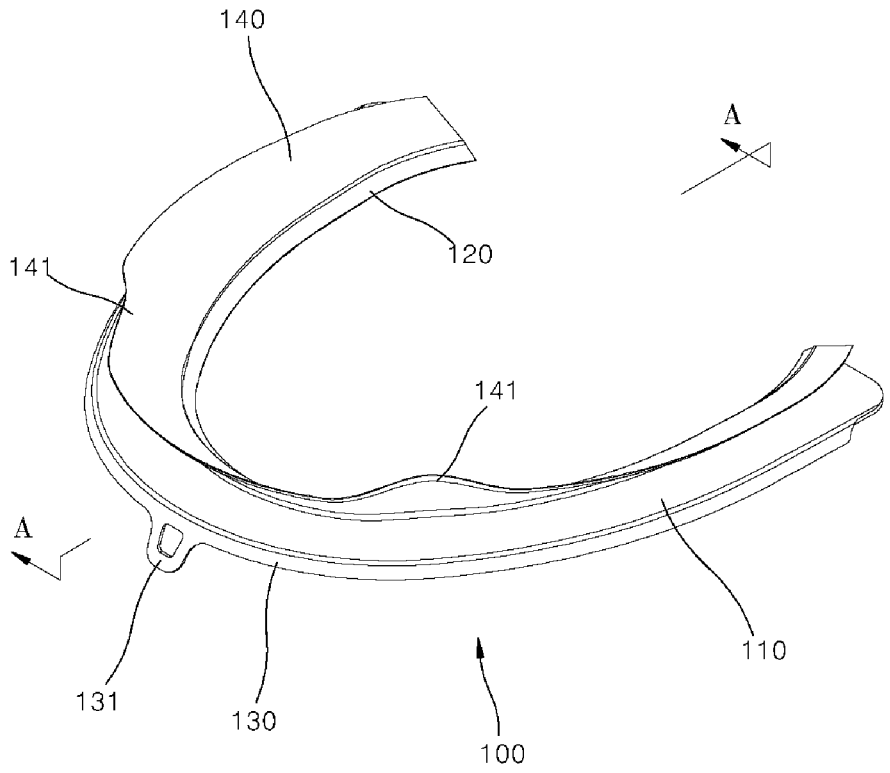

【FIG. 2】
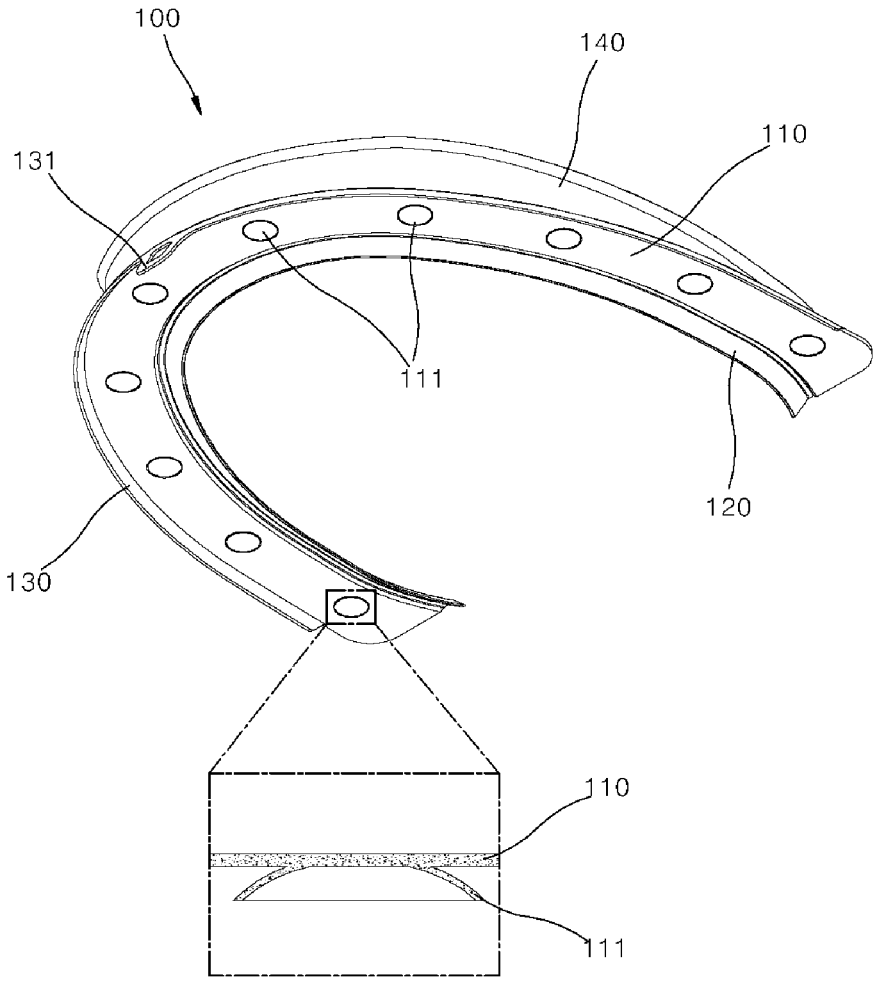

【FIG. 3】
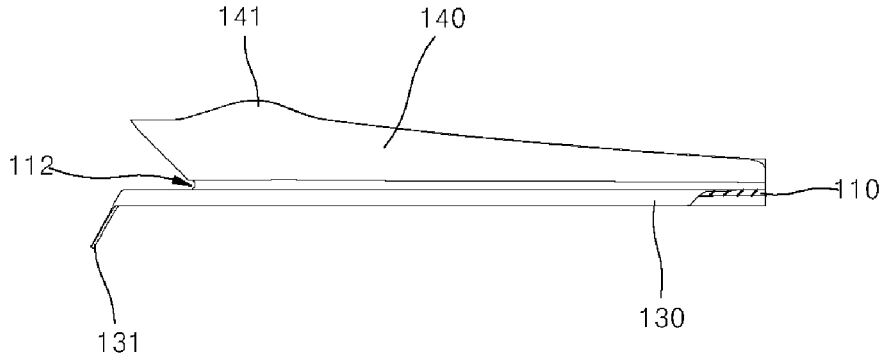
【FIG. 4】
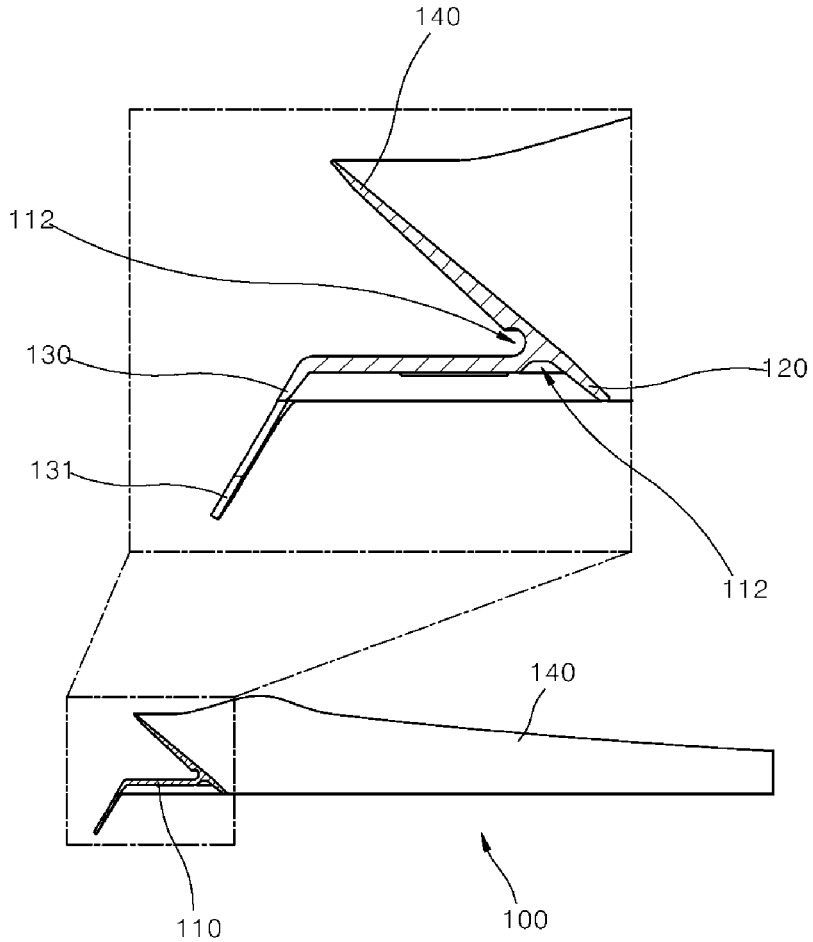

【FIG. 5】
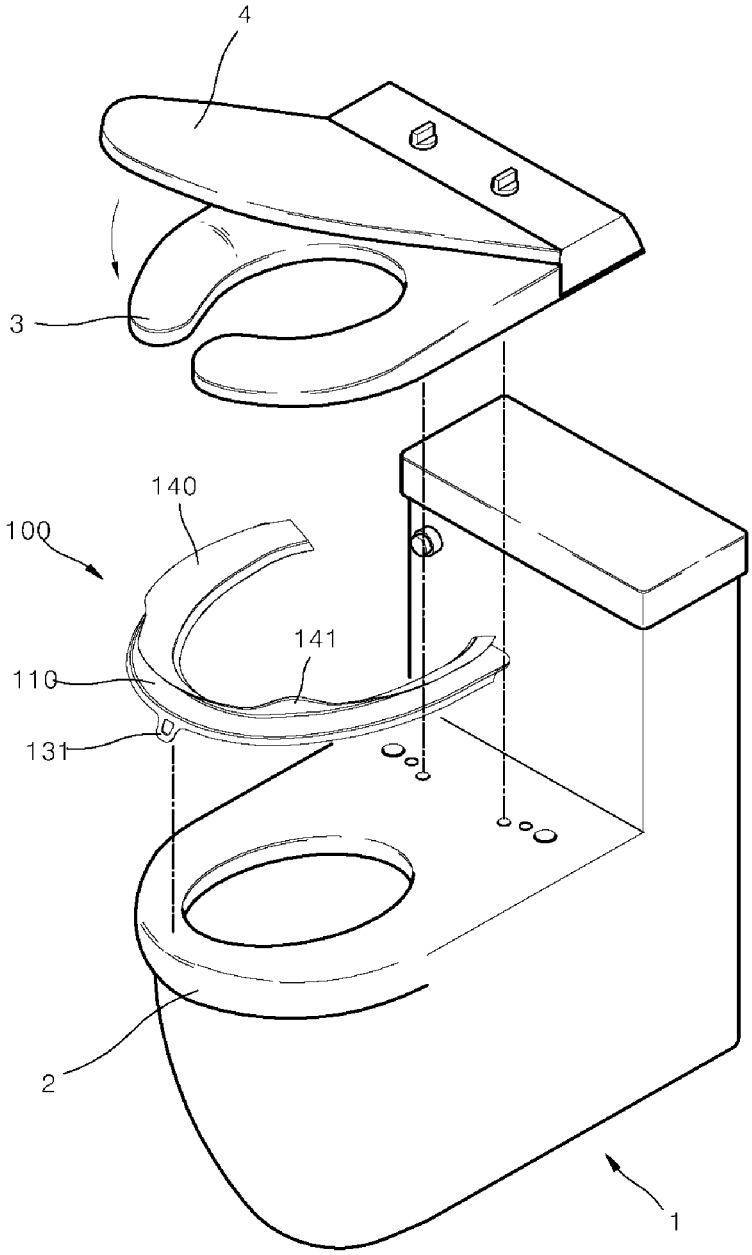

【FIG. 6】
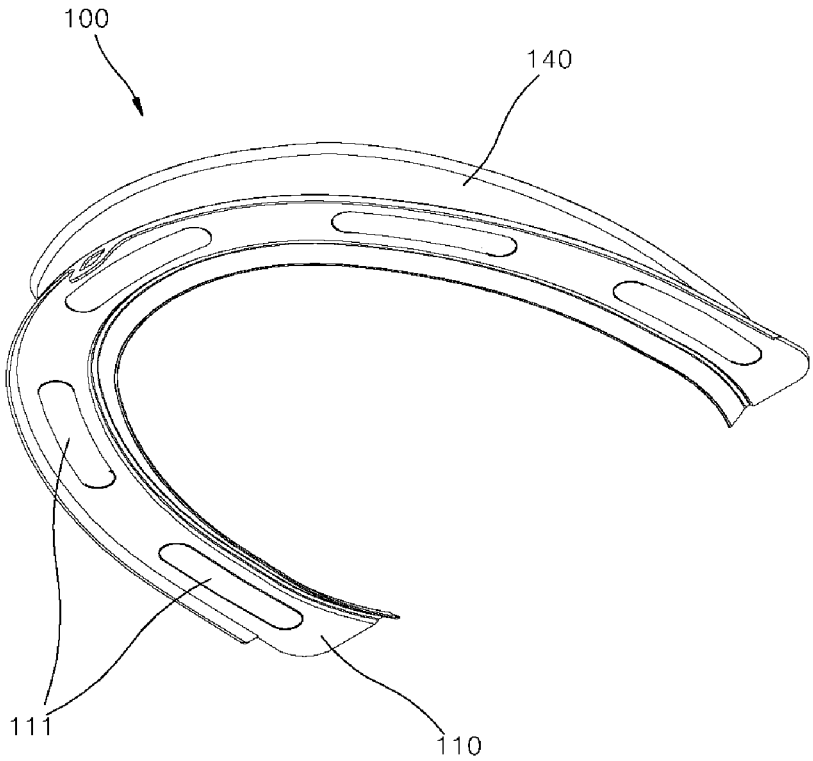

【FIG. 7】
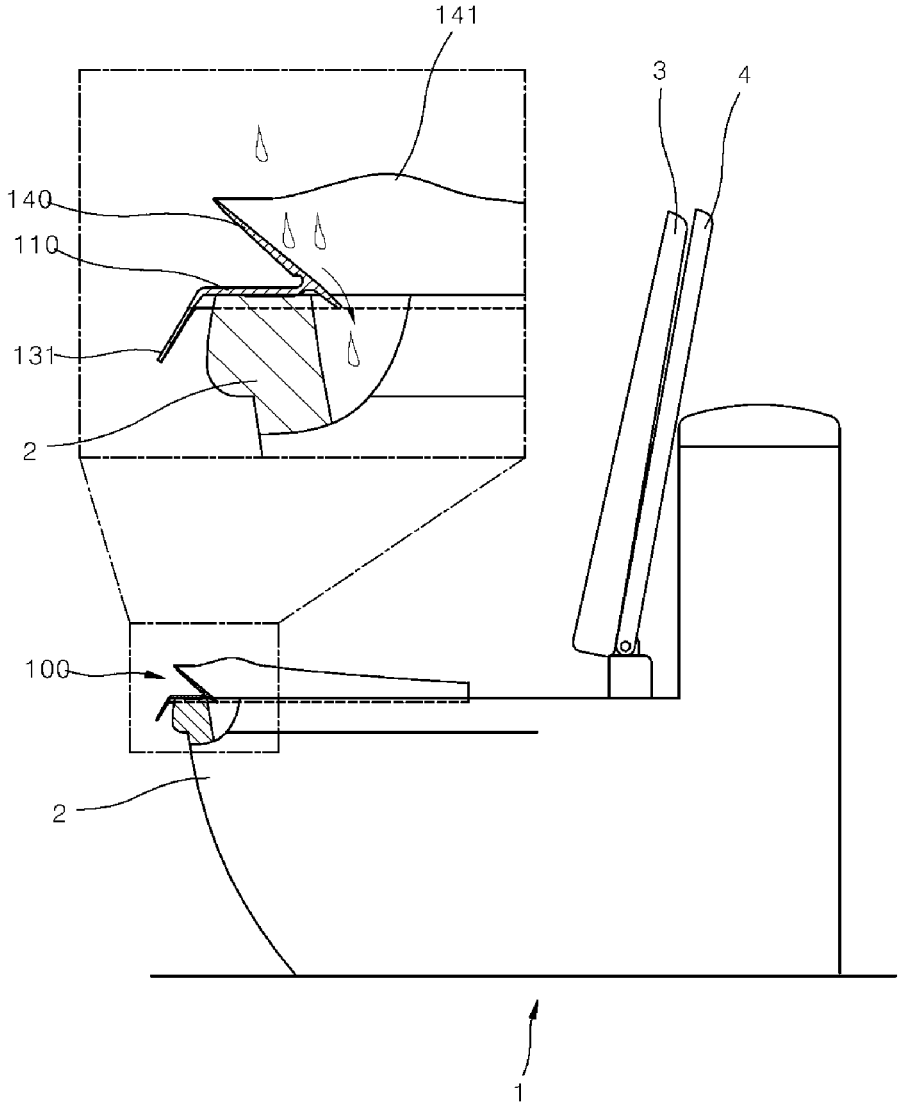

【FIG. 8】
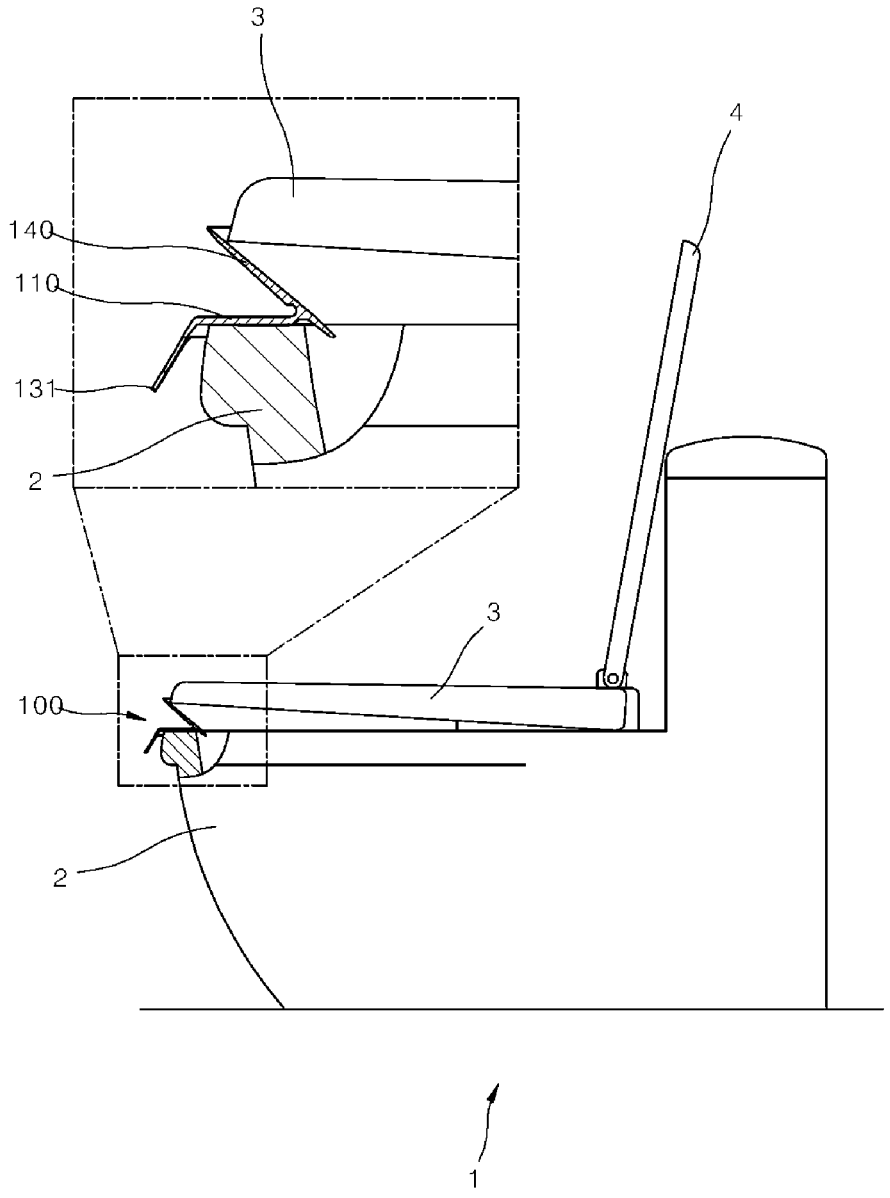

【FIG. 9】
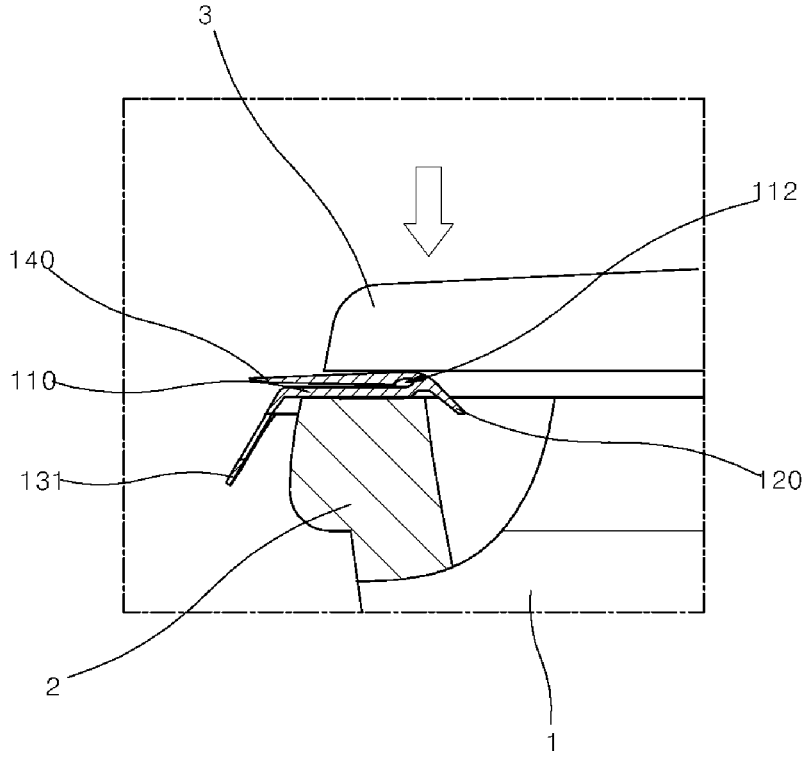

【FIG. 10】
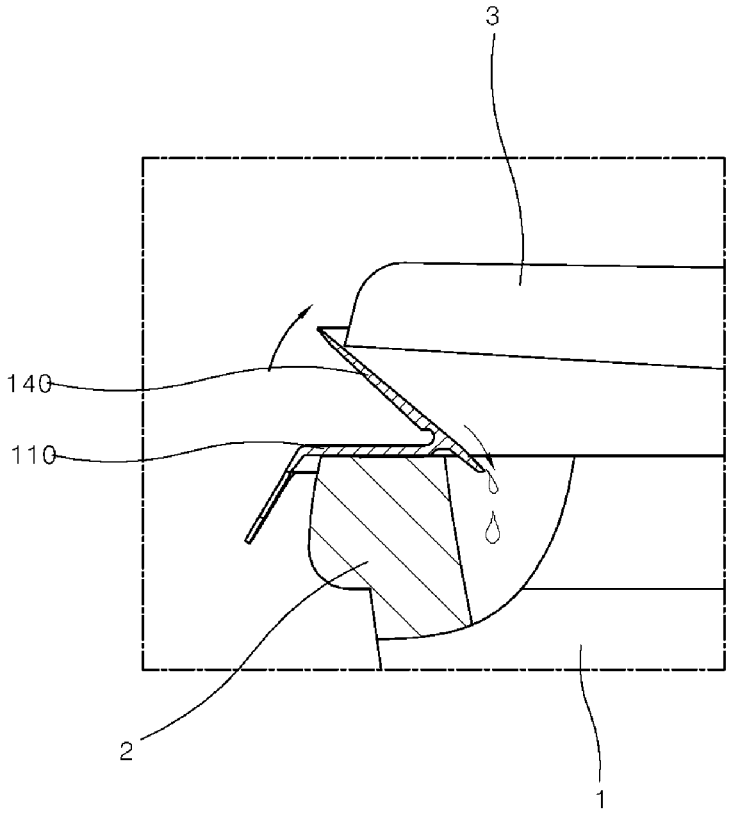

【FIG. 11】
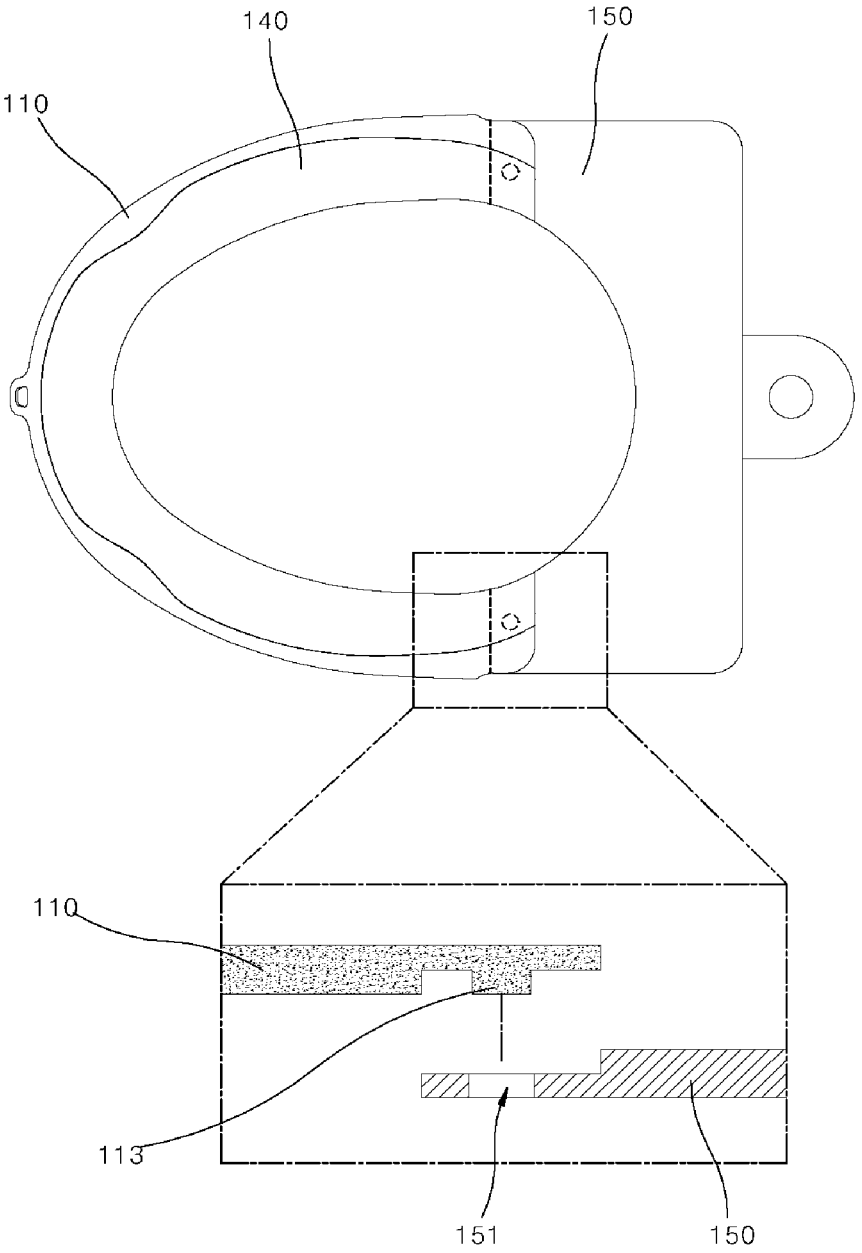

【FIG. 12】
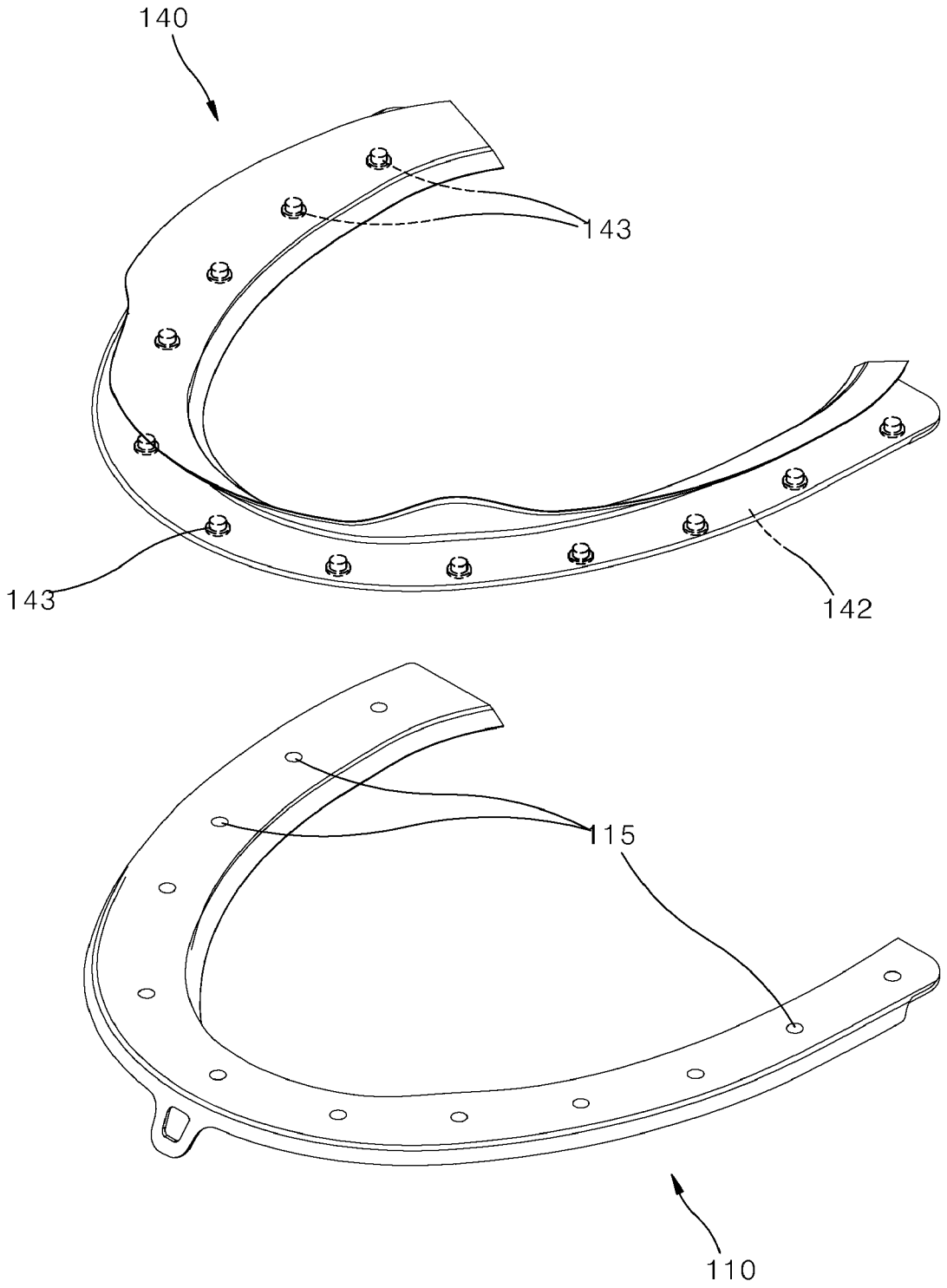

【FIG. 13】
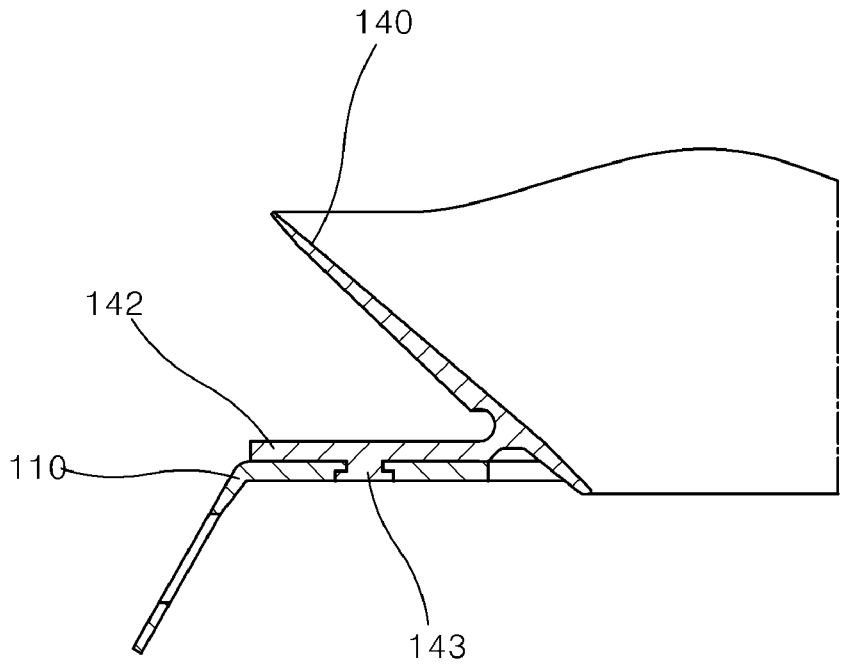

【FIG. 14】
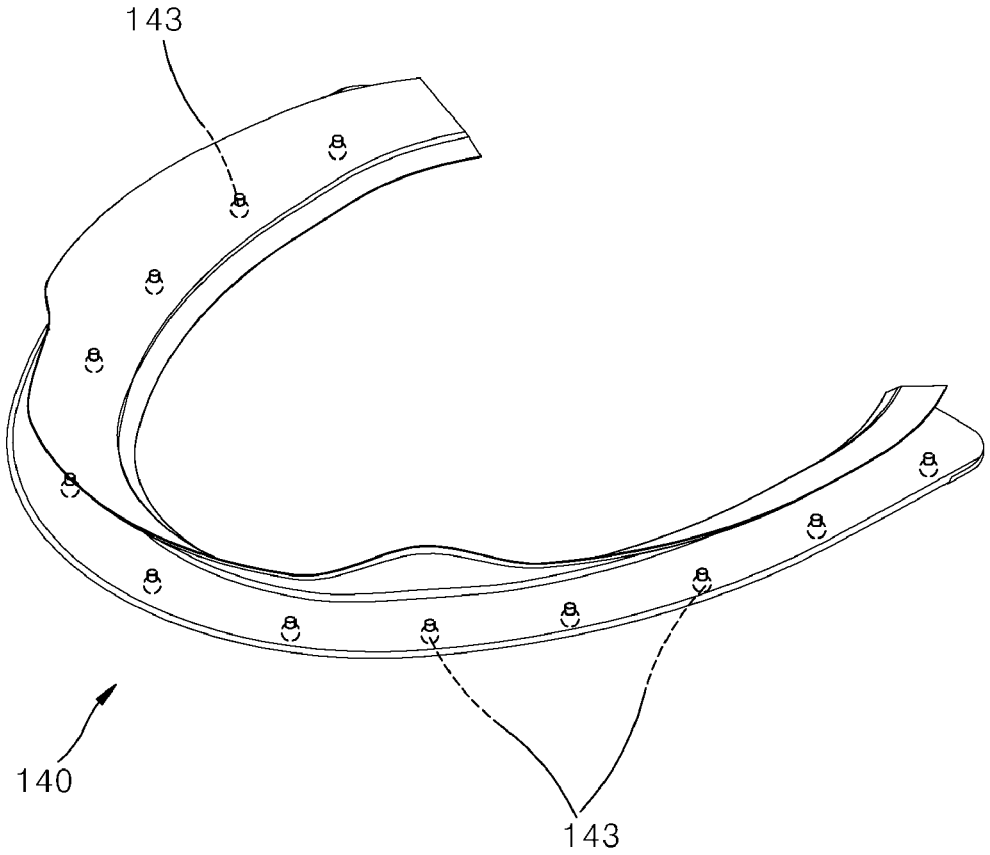

AUXILIARY COVER FOR TOILET SEAT

CROSS REFERENCE TO RELATED APPLICATION OF THE INVENTION

The present application claims the benefit of Korean Patent Application No. 10-2020-0162792 filed in the Korean Intellectual Property Office on Nov. 27, 2020, the entire contents of which are incorporated herein by reference.

BACKGROUND OF THE INVENTION

Field of the Invention

The present invention relates to an auxiliary seat cover for a toilet, and more particularly, to an auxiliary seat cover for a toilet that is capable of preventing urine or water from being splashed to top of a bowl of the toilet, thereby avoiding the bowl of the toilet from being dirty by the urine or water, allowing the urine or water to flow back to the interior of the bowl, and being separated from the bowl and washed after the separation in an easy manner, thereby enabling the toilet to be used in a sanitary state.

Background of the Related Art

Generally, a toilet is located on the floor of a bathroom and has a bowl used for the collection or disposal of human urine and feces, a water tank located at the rear side of the bowl to store wash water therein, a seat rotatably located on top side of the bowl to allow a user to sit thereon, and a cover rotatably located on top of the seat to open and close the top of the bowl.

A given level of water is always stored in the interior of the toilet bowl to prevent bad smell from being produced therefrom, and in the case of a man, he urinates in the toilet in a state where the cover and the seat of the toilet are moved back. In this process, the urine or the water stored in the toilet bowl is splashed to make the toilet or the surrounding area dirty, and accordingly, the top periphery of the toilet bowl may become dirty and cause bad smell therefrom, thereby undesirably making insanitary problems happen. As a result, the toilet has to be washed frequently, which causes many inconveniences in use.

So as to solve such problems, various technologies have been suggested, and their examples are disclosed in the following patent documents.

Referring to a first patent document (Korean Patent Application Laid-open No. 10-2002-0083266 (dated Nov. 2, 2002), a toilet 110 includes a body 120 having an accommodation space 22 into which urine or feces is collected, a seat 130 rotatably located on top side of the body 120 to allow a user to sit thereon, a cover 60 rotatably located on top of the seat 130 to open and close the seat 130, and a collection plate 140 rotatably located on top of the seat and having a collection groove 141 formed on one side surface thereof to collect the urine and a discharge hole 42 formed on one side of the collection groove 141 to allow the urine to flow to the accommodation space 22. According to the first patent document, the toilet can prevent the urine from being splashed to the seat or the outside, but the parts for the prevention have to be additionally provided, thereby making the toilet complicated in configuration and raised in a manufacturing cost. Since the collection plate 140 and a sanitary sheet 150 are fixedly located, further, they cannot be avoided from the contamination, and accordingly, the conventional toilet is not practical in use.

A second patent document relates to a toilet seat for preventing a man's urine from being splashed to the skin contact surface as top thereof if he urinates in the toilet in the standing position, and the conventional toilet seat includes: two fixed plates fixed to tops of both outer surfaces of a toilet body by means of fixing means; two opening and closing sheets rotatable around hinges in such a manner as to allow outer sides of the lower portions thereof to be connected to the tops of the fixed plates by means of the hinges and having protrusions formed on the outsides thereof in such a manner as to protrude outward from the hinges, the lower portions of the two opening and closing sheets being formed of curved plates long in forward and backward directions in such a manner as to come into contact with the side peripheries of the top of the toilet body; and weight descending means located on the lower portions of the outward protrusions of the opening and closing sheets in such a manner as to allow the outward protrusions of the opening and closing sheets to be descended to a lower position than the hinges by means of weights thereof, so that in a state where a person does not sit on the opening and closing sheets, the inner sides of the opening and closing sheets are ascended to permit the opening and closing sheets to be open slant downward from the inner sides thereof to the outer sides thereof. According to the second patent document, the toilet seat is configured to have the opening and closing sheets separated into both sides and rotatable by means of the hinges, so that normally, the opening and closing sheets are moved to the outsides, and if a man urinates in the toilet in the standing position, accordingly, the tops of the opening and closing sheets are not stained with the urine.

According to the second patent document, the toilet seat is not directly stained with the urine, but the toilet bowl or the surrounding floor may be stained with the urine, thereby failing to prevent the urine from being splashed to the outside. Further, the opening and closing sheets are fixedly provided so that it is hard to wash the toilet.

SUMMARY OF THE INVENTION

Accordingly, the present invention has been made in view of the above-mentioned problems occurring in the related art, and it is an object of the present invention to provide an auxiliary seat cover for a toilet that is capable of preventing urine or water scattering by the urine from being splashed to the outside, so that a toilet bowl may not be dirty by the urine or water, thereby enabling the toilet to be used sanitarily.

It is another object of the present invention to provide an auxiliary seat cover for a toilet that is capable of allowing scattering urine or water from easily flowing to the interior of a bowl of the toilet, thereby preventing the bowl from being dirty by the urine or water.

It is yet another object of the present invention to provide an auxiliary seat cover for a toilet that is capable of being simply attached to the top periphery of a bowl of the toilet, so that if it is polluted, it is easily separated from the bowl and then washed, thereby being repeatedly used in a sanitary state.

It is still another object of the present invention to provide an auxiliary seat cover for a toilet that is capable of being stably attached to the top of a bowl of the toilet, thereby giving no inconvenience in use while a seat of the toilet is moved down and then used.

To accomplish the above-mentioned objects, according to the present invention, there is provided an auxiliary seat cover for a toilet, including: a seat part having the shape of an arch corresponding to the top periphery of a bowl of the toilet; inner and outer skirt parts extended downward from inner and outer peripheries of the seat part in such a manner as to surround the inner and outer peripheries of top of the bowl of the toilet; and a slant cover extended upward from the inner periphery of top of the seat part to the outside.

According to the present invention, desirably, the seat part includes a plurality of absorbers located on the underside thereof so that the seat part is fixedly attached to the bowl of the toilet.

According to the present invention, desirably, the absorbers have a round or oval shape, and through the formation of the absorbers, the auxiliary seat cover is easily detached from the toilet.

According to the present invention, desirably, the outer skirt part includes a handle protruding from one end thereof, so that the auxiliary seat cover can be easily separated from the toilet by means of the handle, and the handle has the shape of a loop.

According to the present invention, desirably, the slant cover includes one or more bent portions formed on the outer periphery thereof.

According to the present invention, desirably, the bent portions apply given elasticity and stress to the slant cover so that the slant cover, which is pressurized against a seat of the toilet, is easily returned to the original shape thereof, and the slant cover is kept flat when folded.

According to the present invention, desirably, between a periphery along which the top of the seat part and the underside of the slant cover come into contact with each other and between a periphery along which the underside of the seat part and the inner skirt part come into contact with each other, are formed indentation portions, so that when the slant cover is pressurized against the seat of the toilet, the indentation portions provide given softness and elasticity to the slant cover.

According to the present invention, desirably, the auxiliary seat cover further includes an auxiliary seat part connected to both ends of the rear side of the seat part in such a manner as to cover the remaining top periphery of the bowl of the toilet.

According to the present invention, desirably, the seat part, the inner and outer skirt parts, and the slant cover are made of a soft elastic material in such a manner as to be formed unitarily with each other.

According to the present invention, desirably, the seat part, the inner and outer skirt parts, and the slant cover are molded unitarily with each other and are coated with urethane on the surfaces thereof to prevent water or dust from being attached thereto.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIG. 1 is a perspective view showing an auxiliary seat cover for a toilet according to an embodiment of the present invention;

FIG. 2 is a bottom perspective view showing the auxiliary seat cover for a toilet of FIG. 1;

FIG. 3 is a side view showing the auxiliary seat cover for a toilet of FIG. 1;

FIG. 4 is a sectional view taken along the line A-A of FIG. 1;

FIG. 5 is a perspective view showing a state where the auxiliary seat cover is attached to the toilet;

FIG. 6 is a bottom perspective view showing another example of the absorbers of the auxiliary seat cover for a toilet according to the present invention;

FIG. 7 is a side view showing an installation state of the auxiliary seat cover according to the present invention;

FIGS. 8 to 10 are partially side views showing states where the auxiliary seat cover according to the present invention comes into contact with a toilet seat;

FIG. 11 is a plan view showing an auxiliary seat cover for a toilet according to another embodiment of the present invention;

FIG. 12 is an exploded perspective view showing an auxiliary seat cover for a toilet according to still another embodiment of the present invention;

FIG. 13 is a sectional view showing coupling among main parts of FIG. 12; and FIG. 14 is a perspective view showing another example of the slant cover of the auxiliary seat cover of FIG. 12.

DETAILED DESCRIPTION OF THE PREFERRED EMBODIMENTS

Hereinafter, an auxiliary seat cover for a toilet according to the present invention will be described in detail below with reference to the accompanying drawings. All terms used in the description and claims herein have the same meanings which are typically understood by those having ordinary skill in the art. The terms, such as ones defined in common dictionaries, should be interpreted as having the same meanings as terms in the context of pertinent technology, and should not be interpreted as having ideal or excessively formal meanings unless clearly defined in the specification.

The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

In the drawings, the corresponding parts in the embodiments of the present invention are indicated by corresponding reference numerals.

FIG. 1 is a perspective view showing an auxiliary seat cover for a toilet according to an embodiment of the present invention, FIG. 2 is a bottom perspective view showing the auxiliary seat cover for a toilet of FIG. 1, FIG. 3 is a side view showing the auxiliary seat cover for a toilet of FIG. 1, FIG. 4 is a sectional view taken along the line A-A of FIG. 1, and FIG. 5 is a perspective view showing a state where the auxiliary seat cover is attached to the toilet. Referring to FIGS. 1 to 5, an auxiliary seat cover 100 for a toilet according to an embodiment of the present invention includes a seat part 110 attached to the top periphery of a bowl 2 of the toilet 1, skirt parts 120 and 130 extended downward from the inner and outer peripheries of the seat part 110, and a slant cover 140 having an upward slant surface from the seat part 110.

The seat part 110 has the shape of an arch corresponding to the top periphery of the bowl 2 and serves to cover the top periphery of the bowl 2. Further, the inner skirt part 120 and the outer skirt part 130 are extended downward from the inner and outer peripheries of the seat part 110, and they are shaped to surround the inner and outer peripheries of the top of the bowl 2.

The seat part 110 has a plurality of absorbers 111 located on the underside thereof, and if the seat part 110 is placed on top of the bowl 2 and is then compressed against the bowl 2, it can be fixedly attached to the bowl 2 by means of the absorbers 111. The absorbers 111 have a round shape, and otherwise, as shown in FIG. 6, they have an oval shape. Of course, they may have other shapes if necessary.

The outer skirt part 130 has a handle 131 protruding from one end thereof so that if it is desired to separate the auxiliary seat cover 100 attached to the toilet 1 from the toilet 1, the handle 131 is just lifted up. Desirably, the handle 131 has the shape of a loop.

The slant cover 140 is extended upward from the inner periphery of the seat part 110 and has an internal angle of about 15 to 45° with respect to the seat part 110 in such a manner as to be slant upward to have a given slant surface toward an interior of the bowl 2. Further, the top periphery of the slant cover 140, which is slant toward the interior of the bowl 2, is connected to the inner skirt part 120 to have the same slant surface as the inner skirt part 120.

Accordingly, it is appreciated that the inner skirt part 120 is a member that is just extended from the slant cover 140.

Desirably, the slant cover 140 becomes gradually small in thickness toward a periphery of the free end thereof and has one or more bent portions 141 formed in the middle of the outer periphery thereof. The bent portions 141 are curvedly formed to apply given elasticity and stress to the slant cover 140 so that if they are pressurized against a seat 3 of the toilet 1 to come into contact with the seat part 110, they become flat to extend their surface, thereby preventing their breakage, and further, they are easily returned to their original shape from the pressurized state by means of the curved shapes.

Further, indentation portions 112 are formed between a periphery along which the top of the seat part 110 and the underside of the slant cover 140 come into contact with each other and between a periphery along which the underside of the seat part 110 and the inner skirt part 120 come into contact with each other, and even if the slant cover 140 is repeatedly moved down or up according to the pressurization of the seat 3, the indentation portions 112 serve to provide sufficient softness and elasticity to the slant cover 140, thereby preventing the slant cover 140 from being cracked or broken.

The indentation portions 112 have a sectional shape of 'o' or rhombus.

The auxiliary seat cover 100 for the toilet according to the present invention is desirably configured to allow the seat part 110, the skirt parts 120 and 130, and the slant cover 140 to be molded unitarily with each other, so that the auxiliary seat cover 100 is made of a soft elastic material like silicone, rubber, and so on. Further, the surface of the auxiliary seat cover 100 is coated with urethane to prevent water or dust from being attached thereto, and otherwise, the silicone or rubber as the raw material of the auxiliary seat cover 100 is mixedly molded with oil, a water repellent, and so on, thereby preventing water from being attached to the surface thereof. Otherwise, the raw material may be mixed with an antibacterial agent or flavor, thereby suppressing the cultivation of germs and removing bad smell, and further, the raw material may be mixedly molded with carbon materials, thereby enhancing the density thereof.

As shown in FIG. 5, the auxiliary seat cover 100 for the toilet according to the present invention is attached to the top of the bowl 2 of the toilet 1, and to do this, the auxiliary seat cover 100 is pressurized against the bowl 2 by means of the absorbers 111 located on the underside of the seat part 110 in a state where the seat 3 and the cover 4 of the toilet 1 are lifted up. In a normal state where the auxiliary seat cover 100 is attached to the bowl 2, the slant cover 140 always has the given slant surface.

In this case, if a person urinates in the toilet to cause urine or water to be splashed, as shown in FIG. 7, the slant cover 140, which surrounds the top periphery of the bowl 2, prevents the urine or water from scattering to the outside of the toilet 1, so that the urine or water scattering onto the slant cover 140 flows back to the interior of the bowl 2 along the slant surface of the slant cover 140.

The auxiliary seat cover 100 for the toilet according to the present invention can be conveniently separated from the bowl 2 if the handle 131 is lifted up, and after the auxiliary seat cover 100 is washed, next, it is attached to the bowl 2 of the toilet 1 again.

Accordingly, the toilet 1 can be sanitarily used, while being always kept clean.

FIGS. 8 to 10 show the states where the seat 3 of the toilet 1 is used in the state where the auxiliary seat cover 100 is attached to the top of the bowl 2 of the toilet 1. Referring to FIG. 8, the seat 3 is moved down to allow a periphery of the underside end thereof to come into contact with the slant cover 140, and referring to FIG. 9, the slant cover 140 is completely pressurized against the seat 3 so that the slant cover 140 comes into contact with the seat part 110. Referring to FIG. 10, if the seat 3 is lifted up after the disposal of urine or feces, the slant cover 140 is returned to its original state.

Like this, the auxiliary seat cover 100 for the toilet according to the present invention can be still used in the state of being attached to the bowl 2 even when the seat 3 is moved down for the disposal of urine or feces, cannot be broken by the seat 3 or separated from the seat 3, can provide elastic seat comfort for a user, and can be returned to its original state, without any separate control, so that the auxiliary seat cover 100 can be conveniently used.

FIG. 11 is a plan view showing an auxiliary seat cover for a toilet according to another embodiment of the present invention, and in this case, the auxiliary seat cover 100 further includes an auxiliary seat part 150 connected to the rear end thereof.

That is, the auxiliary seat cover 100 for the toilet according to another embodiment of the present invention includes the auxiliary seat part 150 having the corresponding shape to the remaining top periphery of the bowl 2 covered with the arch-shaped seat part 110, and the auxiliary seat part 150 is partially laid onto the seat part 110 in such a manner as to be detachably coupled to the seat part 110 by means of coupling protrusions 113 and coupling grooves 151 as detachable means.

Under the above-mentioned configuration, the auxiliary seat cover 100 can be selected according to the existence and non-existence of a bidet selectively used for the toilet, and in this case, the detachable means may have various shapes as well known. Further, the auxiliary seat part 150 may be configured unitarily with the seat part 110.

FIGS. 12 to 14 show an auxiliary seat cover for a toilet according to still another embodiment of the present invention, and referring to FIGS. 12 to 14, a seat part 110 and a slant cover 140 of an auxiliary seat cover 100 are separable from each other. Further, the seat part 110 has a plurality of coupling grooves 115 formed on a contact surface with the slant cover 140, and the slant cover 140 has a plurality of coupling protrusions 143 formed on a contact surface with the seat part 110 in such a manner as to correspond to the plurality of coupling grooves 115, so that the seat part 110 and the slant cover 140 are detachably coupled to each other.

In this case, the slant cover 140 has a coupling member 142 disposed on the bottom periphery thereof in such a manner as to be laid on the seat part 110, but of course, the bottom periphery of the slant cover 140 may be coupled directly to the seat part 110, without any coupling member 142.

Further, as shown in FIG. 13, the coupling protrusions 143 may have spherical end portions so that they can be gently coupled to the coupling grooves 115.

As described above, the auxiliary seat cover for the toilet according to the present invention is attached to the top periphery of the bowl of the toilet to cover the top of the bowl and is provided with the upward slant cover adapted to prevent urine or water scattering by the urine from being splashed to the outside, so that the bowl of the toilet may not be dirty by the urine or water, thereby enabling the toilet to be sanitarily used.

In addition, the auxiliary seat cover for the toilet according to the present invention is configured to allow scattering urine or water from easily flowing to the interior of the bowl of the toilet by means of the upward slant cover, thereby preventing the bowl from being dirty by the urine or water.

Further, the auxiliary seat cover for the toilet according to the present invention is provided with the absorbers disposed on the underside of the seat part, so that the auxiliary seat cover can be simply attached to the top periphery of the bowl of the toilet, and if it is polluted, it is easily separated from the bowl and thus washed, thereby being repeatedly used in a sanitary state.

Moreover, the auxiliary seat cover for the toilet according to the present invention is made of the soft material like silicone or rubber, so that even when the seat of the toilet is moved down, the auxiliary seat cover can be still used, without any separation from the bowl, and while the user is seating on the seat of the toilet, the auxiliary seat cover provides good seat comfort, thereby causing no inconvenience in use.

While the invention has been described with respect to specific embodiments, one skilled in the art will recognize that numerous modifications are possible without departing from the scope and spirit of the present invention. For example, the bent portions 141 curvedly formed on the slant cover 140 may be narrowly corrugated if necessary, and the outer shapes of the seat part, the skirt parts, and the slant cover may be arbitrarily changed according to the structure or design of the toilet or bidet or according to a consumer's demand.

What is claimed is:

1. An auxiliary seat cover for a toilet, comprising:

a seat part having the shape of an arch corresponding to the top periphery of a bowl of the toilet;

inner and outer skirt parts extended downward from inner and outer peripheries of the seat part in such a manner as to surround the inner and outer peripheries of top of the bowl of the toilet; and a slant cover extended upward from the inner periphery of top of the seat part to the outside.

2. The auxiliary seat cover according to claim 1, wherein the seat part comprises a plurality of absorbers located on the underside thereof so that the seat part is fixedly attached to the bowl of the toilet.

3. The auxiliary seat cover according to claim 1, wherein the outer skirt part comprises a handle protruding from one end thereof.

4. The auxiliary seat cover according to claim 3, wherein the handle has the shape of a loop.

5. The auxiliary seat cover according to claim 1, wherein the slant cover comprises one or more bent portions formed on the outer periphery thereof.

6. The auxiliary seat cover according to claim 1, wherein between a periphery along which the top of the seat part and the underside of the slant cover come into contact with each other and between a periphery along which the underside of the seat part and the inner skirt part come into contact with each other, are formed indentation portions.

7. The auxiliary seat cover according to claim 1, further comprising an auxiliary seat part connected to both ends of the rear side of the seat part in such a manner as to cover the remaining top periphery of the bowl of the toilet.

8. The auxiliary seat cover according to claim 1, wherein the seat part, the inner and outer skirt parts, and the slant cover are made of a soft elastic material in such a manner as to be formed unitarily with each other.

9. The auxiliary seat cover according to claim 1, wherein the seat part, the inner and outer skirt parts, and the slant cover are molded unitarily with each other and are coated with urethane on the surfaces thereof to prevent water or dust from being attached thereto.

10. The auxiliary seat cover according to claim 1, wherein the seat part and the slant cover are detachably coupled to each other.

11. The auxiliary seat cover according to claim 10, wherein the seat part and the slant cover are separable from each other, and so as to allow seat part and the slant cover to be detachably coupled to each other, the seat part has a plurality of coupling grooves formed on a contact surface with the slant cover, and the slant cover has a plurality of coupling protrusions formed on a contact surface with the seat part in such a manner as to correspond to the plurality of coupling grooves.

* * * * *